United States Patent [19]

Giannelli et al.

[11] Patent Number: 4,582,318

[45] Date of Patent: Apr. 15, 1986

[54] EXERCISER MACHINE HAVING DUAL CHAIN DRIVE FOR A VARIABLE RESISTANCE DEVICE

[75] Inventors: Raymond Giannelli, Ronkonkoma; Matthew R. Martin, Sayville, both of N.Y.

[73] Assignee: Lumex, Inc., Bayshore, N.Y.

[21] Appl. No.: 608,031

[22] Filed: May 7, 1984

Related U.S. Application Data

[63] Continuation-in-part of Ser. No. 507,473, Jun. 24, 1983, abandoned.

[51] Int. Cl.[4] ..... A63B 21/22; A63B 21/00

[52] U.S. Cl. ..... 272/73; 272/132; 272/130; 280/261; 74/812

[58] Field of Search ..... 272/73, 132, 134, 130; 128/25 R, 25 B; 74/812; 474/73, 74; 280/261

[56] References Cited

U.S. PATENT DOCUMENTS

| | | | |
|---|---|---|---|
| 797,814 | 8/1905 | Mimard | 74/812 |
| 2,513,197 | 6/1950 | Moshier | 128/25 B |
| 4,475,872 | 10/1984 | Foughty | 74/812 |

*Primary Examiner*—Richard J. Apley
*Assistant Examiner*—S. R. Crow
*Attorney, Agent, or Firm*—Edward H. Loveman

[57] ABSTRACT

An exerciser device has a rotary crank assembly turnable in opposite selected directions and driving an endless first chain entrained on sprockets. The chain drives through a first engaged clutch when the crank assembly is turned in one direction to turn a wheel which drives a variable resistance device such as a variable delivery pump. A second chain entrained on other sprockets which are driven by the first chain when engaged by a second clutch, to drive the wheel when the crank assembly is turned in opposite direction. The wheel always turns in the same direction regardless of the direction in which the crank assembly is turned.

10 Claims, 5 Drawing Figures

EXERCISER MACHINE HAVING DUAL CHAIN DRIVE FOR A VARIABLE RESISTANCE DEVICE

This application is a continuation-In-Part Application of U.S. patent application Ser. No. 507,473, filed on June 24, 1983, which is now abandoned.

This invention relates to the art of exerciser machines and more particularly concerns an exerciser machine of the type in which a hand crank is rotatable against a variable resistance.

Various types of exerciser machines have been known heretofore in which a pump is driven in one direction by gears to provide variable resistance to rotation of a pedal crank drivable in opposite directions. The mechanisms of the prior machines are complicated, costly to manufacture, and require frequent servicing to keep them operating properly.

The present invention is directed at an exerciser machine which is simpler in construction, less expensive to manufacture, and provides long troublefree service. According to the invention, the exerciser machine is provided with a double chain clutch controlled drive. The two chains operate alternately to drive a variable resistance pump in one direction, when a manually operable crank is driven in opposite directions. This exerciser machine is lighter in weight and more maneuverable than prior exerciser machines of this type.

These and other objects and many of the attendant advantages of this invention will be readily appreciated as the same becomes better understood by reference to the following detailed description when considered in connection with the accompanying drawings in which.

Figure 1:
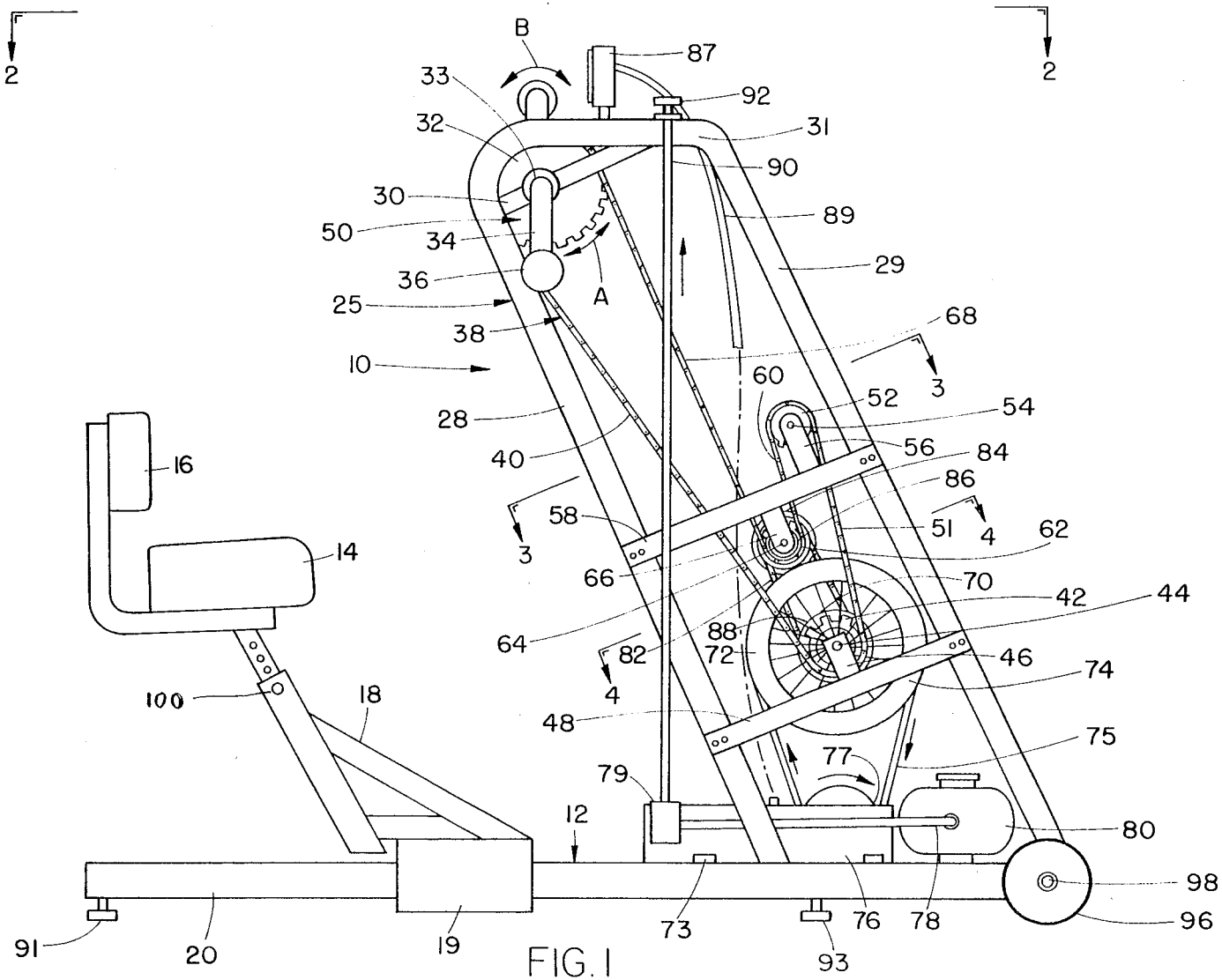
FIG. 1 is a side elevational view of an exerciser machine embodying the invention.
Figure 2:
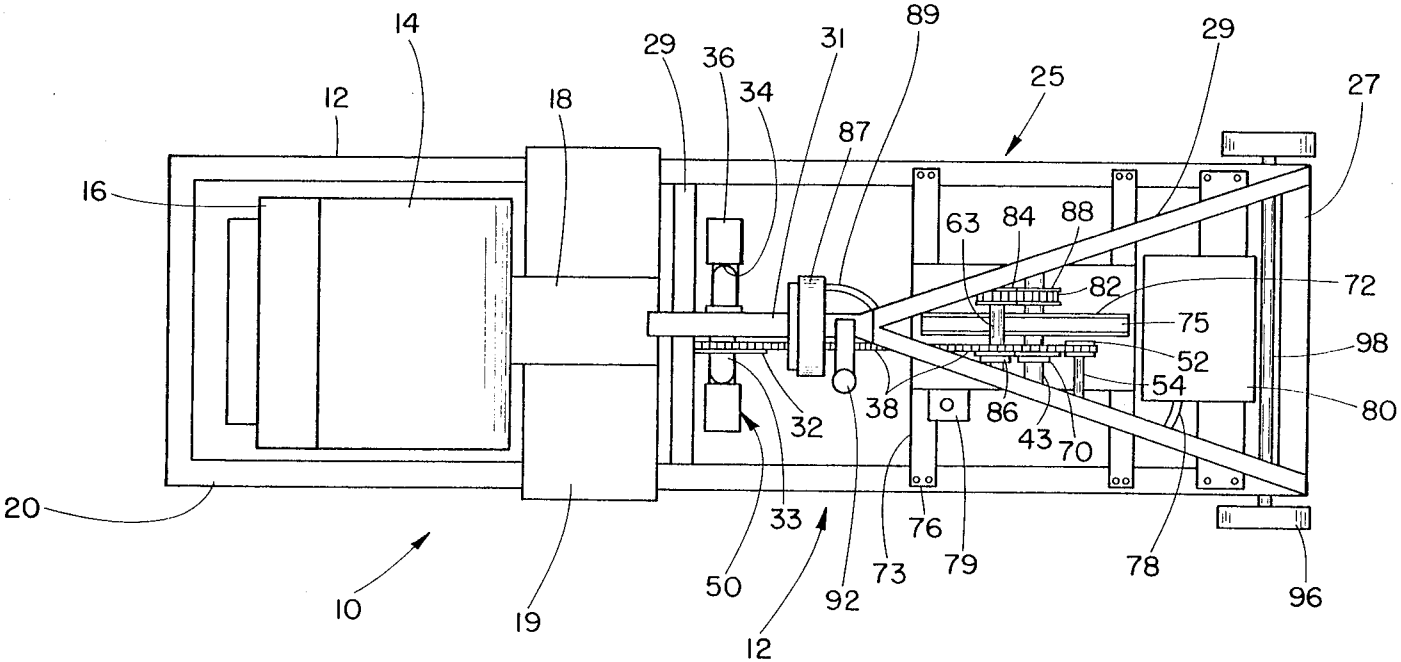
FIG. 2 is a top plan view of the machine taken along line 2—2 of FIG. 1.
Figure 3:
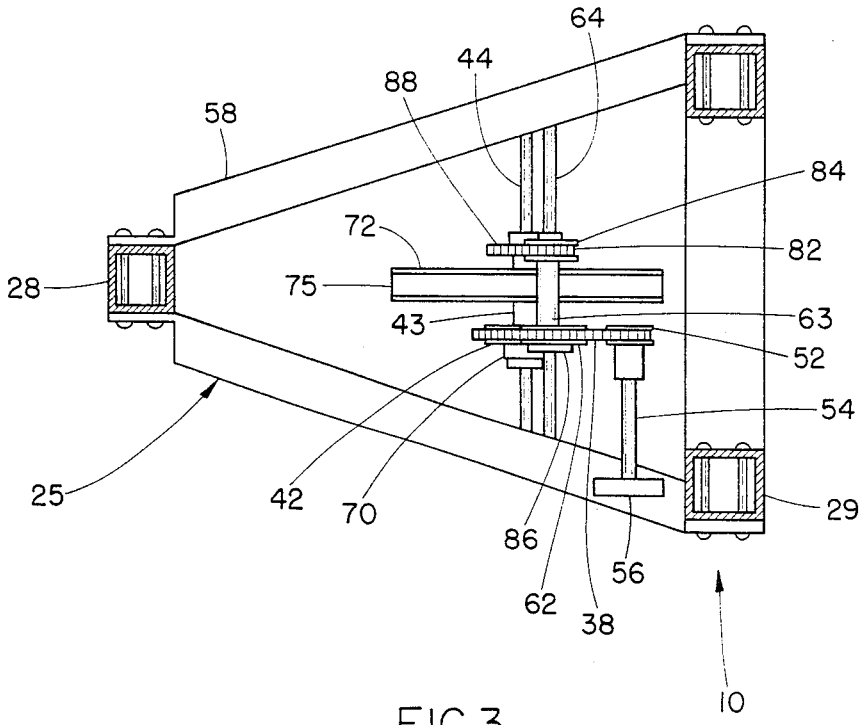
FIG. 3 and FIG. 4 are cross sectional views taken along lines 3—3 and 4—4 respectively of FIG. 1.
Figure 4:
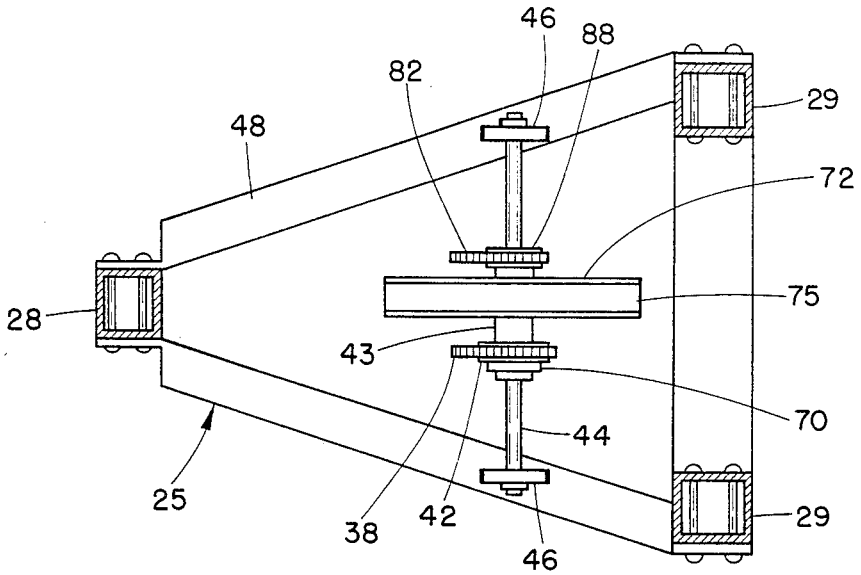

Referring now to the drawings wherein like reference characters designate like or corresponding parts throughout, there is illustrated in FIGS. 1–4 an exerciser machine generally designated as reference numeral 10 having a rectangular base frame 12 on which is adjustably mounted a seat 14 and a backrest 16. The seat 14 is carried by brace bars 18 on a carriage 19 which is adjustably positionable on side rails 20 of the frame 12. The seat 14 may be adjustably spaced from a framework, generally designated as reference numeral 25 which carries the operating parts of the exerciser machine 10.

The framework 25 has a rear downwardly and forwardly inclined rail 28 secured to a cross bar 29 extending across the rails 20 of the base frame 12. The upper end of the rail 28 is integral with one end of a horizontal rail 31. The other end of the rail 31 is secured to the upper ends of two rails 29 which diverge laterally downward in a forwardly inclined position as clearly shown in FIGS. 1 and 2. The lower ends of the rails 29 are secured to the horizontal front rail 27 of the base frame 12. The rails 28 and 31 carry an upper brace bar 30 which rotatably supports a crank assembly 50 which includes a large sprocket 32 and two oppositely directed crank arms 34 each having a laterally extending hand grip 36. The sprocket 32 and the crank arms 34 show may be rotated on a shaft 33 in one direction or the other as indicated by arrows A, B in FIG. 1. The sprocket 32 is rotatable in a vertical plane and carries an endless chain 38 engaged on teeth of the sprocket 32. One Section 40 of the chain extends down and around a second sprocket 42 carried on a hub 43 which rotates on a stationary shaft 44 secured and supported at each end thereof by a bracket 46 mounted on a cross brace bar 48, see FIGS. 1 and 4. A section 51 of the chain 38 extends upwardly and is entrained around teeth of a small idler sprocket 52 carried by a shaft 54 supported at one end thereof by a bracket 56 secured to a cross brace bar 58; see FIGS. 1, 3, 5. A section 60 of the chain 38 extends downwardly and around third sprocket 62 rotatably carried by a hub 63 rotating on a stationary shaft 64, supported at each end thereof by a bracket 66 secured to the underside of cross brace bar 58. A section 68 of the chain 38 extends upwardly to the sprocket 32 and therearound to the chain section 40.

A first clutch 70 which may be a conventional type of bicycle clutch is mounted on the hub 43 and is connected between the sprocket 42 and the hub 43. The sprocket 42 can rotate the hub 43 via the clutch 70 when the clutch 70 is engaged. A wheel 72 is secured on the hub 43 and rotates therewith in a vertical plane when the clutch 70 is engaged.

Entrained around a rim 74 of the wheel 72 is a belt 75 which is passed around a pulley 77 of a variable delivery pump 76 which is mounted on cross bars 73 carried by the rails 20. The pump 76 has a control valve 79 connected to a fluid line 78 which extends between the pump 76 and a liquid reservoir or tank 80.

A short endless chain 82 is entrained on another sprocket 84 secured to the hub 63. Another conventional bicycle clutch 86 is mounted on the hub 63 and is connected between the sprocket 62 and the hub 63 to drive the hub 63 and the sprocket 84 when the clutch 86 is engaged. Both of the clutches 70 and 86 engage when rotated in one direction to drive their respective hubs 43, and 63, and disengage when rotated in an opposite direction. The chain 82 is entrained around another lower sprocket 88 secured to the hub 43 and rotatable with it. The chain 38 is disposed at one and the same side of the wheel 72 as the clutches, 70 and 86, and the sprockets 32, 42, 52 and 62. The chain 82 is disposed at the other side of the wheel 72 along with the sprockets 84 and 88.

A pressure gauge 87 which may be calibrated to indicate the resistance presented to rotation of the crank assembly 50 is mounted on the top of the framework 25. A gauge tube 89 extends down from the gauge 87 to the pump 76. A hand operated control cable 90 terminates at an upper knob 92. The lower end of the cable 90 is connected to the valve 79.

Rails 20 rest on feet 91, 93. A pair of wheels 96 are rotatably mounted on a shaft 98 at the forward end of the base frame 12, which may be lifted at its rear end and the exceriser machine 10 may then be tilted upwardly and rolled around on the wheels 98 to any desired location for operation.

The mode of operation of the invention will now be explained with particular reference to FIG. 5. Suppose an operator grasps the handles 36 of the crank assembly 50 and turns the crank arms 34 and sprocket 32 in a clockwise direction indicated by solid line arrow C. The chain section 68 moves down and rotates the sprocket 62 counterclockwise. The chain section 60 moves up and turns the idler sprocket 52 clockwise. The section 51 of the chain 38 moves down and rotates the sprocket 42 clockwise which engages the clutch 70 to rotate the hub 43 clockwise which in turn rotates the wheel 72 clockwise. The belt 75 turns the pulley 88 clockwise to drive the variable delivery pump 76 which passes fluid through the resistance line 78 controlled by the valve 79 and the reservoir 80. The clutch 70 is engaged so that the chain 38 is effective in driving the wheel 72. The hub 43 also rotates the sprocket 88, which now free wheels both the chain 82 and the sprocket 84. The clutch 86 is not engaged and thus, the hub 63 on the shaft 64 is not engaged to the sprocket 62.

Figure 5:
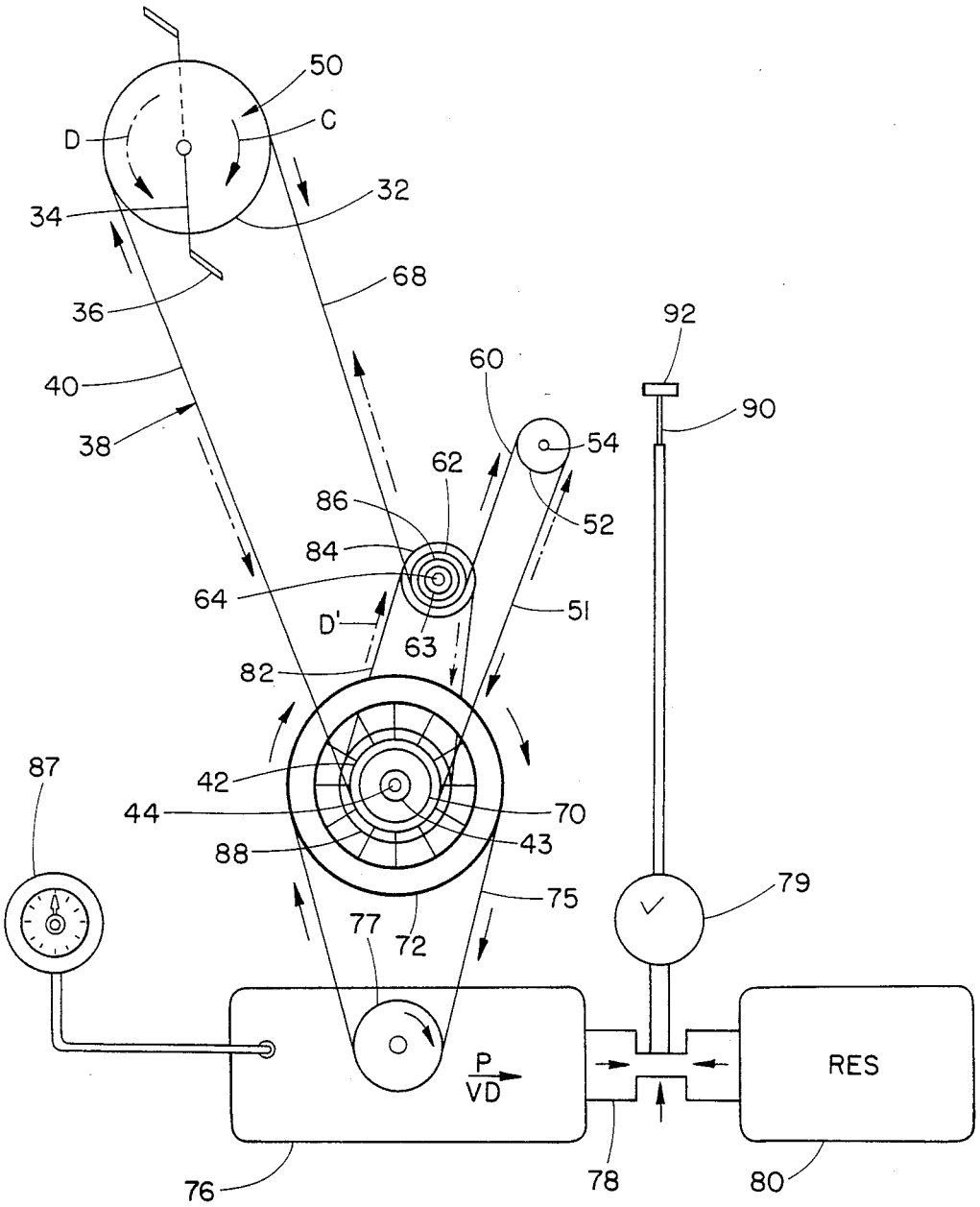
FIG. 5 is a schematic diagram used in explaining the mode of operation of the invention.

Suppose now the crank assembly 50 is turned in the opposite, counterclockwise direction indicated by dotted arrow D in FIG. 5. The chain 38 now moves in directions opposite those described above and shown by solid arrows. The clutch 70 is disengaged so that the chain 38 no longer drives the hub 43 and the wheel 72. Instead the sprocket 62 which is now driven clockwise (FIG. 5) by the chain 38 engaging the clutch 86 to drive the hub 63 clockwise which rotates the sprocket 84 (FIG. 5) clockwise to drive the chain 82 in the direction illustrated by dotted arrows d' in FIG. 5 to rotate the sprocket 88 clockwise. The sprocket 88 is secured to the hub 43 so that this hub rotates clockwise which is the same direction as before when the chain 38 drove the hub 43 clockwise. The wheel 72 again turns clockwise driving the belt 75 clockwise. Thus, the pulley 77 of the pump 76 is always rotated in one direction i.e. clockwise, regardless of the direction in which the crank assembly 50 is turned. The knob 92 and the cable 90 actuate the valve 79 to set the speed which pump 76 imposes upon rotation of the wheel 72. The gauge 87 provides a scale indication of the resistance. The wheel 72 always rotates in the same direction, because the hub 43 always rotates in the same direction.

The exerciser machine may be fabricated economically with standard parts such as conventional bicycle drive clutches, variable delivery pump, sprockets, etc . . . The framework 25 is of rugged all metal construction. The machine provides troublefree service and will have a long useful operational life.

The seat 14 has an adjustment knob 100 located underneath so that the height of the seat may be adjusted. Also the carriage 10 may be adjustably positioned along base frame 12.

It should be understood that the foregoing relates to only a preferred embodiment of the invention which has been by way of example only, and that it is intended to cover all changes and modifications of the example of the invention herein chosen for the purpose of the disclosure, which do not constitute departures from the spirit and scope of the invention.

What is claimed is:

1. In an exerciser machine, transmission means comprising:

a rotary crank assembly selectively turnable in either of two opposite directions by a user manually turning said rotary crank assembly;

a variable resistance device for imparting resistance to said user of said exercise machine;

a rotatable wheel for driving said variable resistance device;

a first clutch;

a first drive chain driven by said crank assembly and operatively driving said wheel in one direction through said first clutch when said crank assembly is turned in one selected direction;

a second clutch; and a second drive chain driven by said first drive chain and operatively driving said wheel in said one direction through said second clutch when said crank assembly is turned in another direction oppositely from said selected direction, so that said variable resistance device is always driven by said wheel rotating in said one direction regardless of the selected direction in which said rotary crank assembly is turned.

2. An exerciser machine, comprising;

a framework;

a rotary crank assembly carried by said framework and having crank means adapted to be turned by an operator of said machine by applying turning torque thereto;

a first endless transmission member driven by said crank assembly in opposite directions when said crank assembly is selectively turned in opposite directions;

a first shaft stationary supported by said framework and carrying a rotatable first hub;

a first sprocket on said first hub, said first transmission member being entrained around said first sprocket to rotate the same when said crank means is turned;

a first clutch on said first hub operatively engaging said first sprocket and said first hub when said first sprocket is rotated in one direction, and disengaging said first sprocket from said first hub when said first transmission member rotates said first sprocket in an opposite second direction;

a variable resistance device for imparting resistance to said operator of said exercise machine;

a wheel for driving said variable resistance device, said wheel being mounted on and rotatable with said first hub;

a second stationary shaft carried by said framework and carrying a second rotatable hub;

a second sprocket carried by said second hub, said first transmission member being entrained around said second sprocket to rotate the same; p1 a third sprocket on said first hub and rotatable therewith;

a fourth sprocket on said second hub and secured thereon to rotated with said second hub a second endless transmission member entrained around said third and fourth sprockets; and a second clutch on said second hub operatively engaging said second sprocket with said second hub when said second sprocket is rotated in said second direction, and disengaging said second sprocket and said second hub when said second sprocket rotates in said one direction, whereby said wheel and said first hub always rotate in the same one direction, regardless of the direction in which said crank assembly is turned, to drive said variable resistance device.

3. An exerciser machine as defined in claim 2, further comprising an idler sprocket rotatably carried by said framework, said first transmission member being so entrained around said idler sprocket so that said idler sprocket always rotates in the same direction as said first and third sprockets.

4. An exerciser machine as defined in claim 3, wherein said crank assembly includes a further sprocket, and a crank which turns said further sprocket, said first transmission member being entrained around said further sprocket for rotating said first, second, and idler sprockets directly.

5. An exerciser machine as defined in claim 4, wherein said first and second transmission members are drive chains.

6. An exerciser as defined in claim 4, further comprising:

a variable resistance device for presenting resistance to rotation by said crank assembly;

a pulley rotatable to drive said variable resistance device; and a transmission member coupling said wheel and pulley, so that said pulley always rotates in said one direction to drive said resistance device regardless of the direction in which said crank assembly is turned.

7. An exerciser as defined in claim 6, further comprising a seat carried by said framework and so disposed that said crank assembly may be turned manually.

8. An exerciser as defined in claim 7, wherein said seat is movably mounted on said framework and wherein said crank assembly includes handles connected to said crank assembly for rotation thereof.

9. An exerciser device as defined in claim 6, further comprising a control on said framework connected to said resistance device for selectively varying speed to rotation of said crank assembly.

10. An exerciser device as defined in claim 9, further comprising a gauge carried by said framework and connected to said resistance device for indicating the resistance to rotation presented to said crank assembly.

* * * * *